US008120415B2

(12) United States Patent
Conte et al.

(10) Patent No.: US 8,120,415 B2
(45) Date of Patent: Feb. 21, 2012

(54) CIRCUIT FOR GENERATING A TEMPERATURE-COMPENSATED VOLTAGE REFERENCE, IN PARTICULAR FOR APPLICATIONS WITH SUPPLY VOLTAGES LOWER THAN 1V

(75) Inventors: Antonino Conte, Tremestieri Etneo (IT); Mario Micciche', Agrigento (IT); Rosario Roberto Grasso, Acicastello (IT)

(73) Assignee: STMicroelectronics S.r.l., Agrate Brianza (IT)

( * ) Notice: Subject to any disclaimer, the term of this patent is extended or adjusted under 35 U.S.C. 154(b) by 138 days.

(21) Appl. No.: 12/464,481

(22) Filed: May 12, 2009

(65) Prior Publication Data

US 2009/0284304 A1 Nov. 19, 2009

(30) Foreign Application Priority Data

May 13, 2008 (EP) ..... 08425331

(51) Int. Cl.
*G05F 1/10* (2006.01)
*G05F 3/02* (2006.01)

(52) U.S. Cl. ..... 327/539

(58) Field of Classification Search ..... 327/512, 327/513, 539; 323/313, 316, 315
See application file for complete search history.

(56) References Cited

U.S. PATENT DOCUMENTS 6,529,066 B1 * 3/2003 Guenot et al. ..... 327/539
7,253,598 B1 * 8/2007 Doyle et al. ..... 323/316
2005/0194957 A1 9/2005 Brokaw
2007/0030050 A1 2/2007 Lee et al.
2007/0080741 A1 4/2007 Yeo et al.
2007/0176591 A1 8/2007 Kimura
2008/0042736 A1 2/2008 Byeon

OTHER PUBLICATIONS

European Search Report for Application Serial No. EP08425331,European Patent Office, Munich, Nov. 20, 2008.
Y. Dai, D. T. Comer, D.J. Comer and C.S. Petrie, "Threshold voltage based CMOS voltage reference", IEE Proceedings: Circuits Devices and System, vol. 151, No. 1, Feb. 2004, pp. 58-62.

* cited by examiner

*Primary Examiner* — Quan Tra
(74) *Attorney, Agent, or Firm* — Lisa K. Jorgenson; Kevin D. Jablonski; Graybeal Jackson LLP

(57) ABSTRACT

An embodiment of a circuit is described for the generation of a temperature-compensated voltage reference of the type comprising at least one generator circuit of a band-gap voltage, inserted between a first and a second voltage reference and including an operational amplifier, having in turn a first and a second input terminal connected to an input stage connected to these first and second input terminal and comprising at least one pair of a first and a second bipolar transistor for the generation of a first voltage component proportional to the temperature. The circuit also comprises the control block connected to the generator circuit of a band-gap voltage in correspondence with at least one first control node which is supplied with a biasing voltage value comprising at least one voltage component which increases with the temperature for compensating the variations of the base-emitter voltage of the first and second bipolar transistors and ensure the turn-on of a pair of input transistors of the operational amplifier. The circuit has an output terminal suitable for supplying a temperature-compensated voltage value obtained by the sum of the first voltage component proportional to the temperature and of a second component inversely proportional to the temperature.

37 Claims, 9 Drawing Sheets

CIRCUIT FOR GENERATING A TEMPERATURE-COMPENSATED VOLTAGE REFERENCE, IN PARTICULAR FOR APPLICATIONS WITH SUPPLY VOLTAGES LOWER THAN 1V

PRIORITY CLAIM

The present application claims the benefit of European Patent Application Serial No.: 08425331.9, filed May 13, 2008, which application is incorporated herein by reference in its entirety.

TECHNICAL FIELD

An embodiment of the present disclosure relates to a circuit for generating a temperature-compensated voltage reference.

More specifically, an embodiment of the disclosure relates to a circuit of the type comprising at least one current reference, inserted between a first and a second voltage reference and including an operational amplifier, having in turn a first and a second input terminal coupled to an input stage comprising a generator circuit of a current proportional to the temperature by means of at least one first bipolar transistor, as well as a current mirror coupled to the first supply voltage reference and inserted between the first and the second input terminal of the operational amplifier and an output terminal of the circuit suitable for supplying this temperature-compensated voltage reference.

An embodiment of the disclosure particularly, but not exclusively, relates to a generator circuit of a voltage of the band-gap type and the following description is made with reference to this field of application by way of illustration only.

BACKGROUND

Circuits for the generation of a voltage reference, also simply indicated as voltage references, are widely used in the integrated circuits for the most varied needs.

These circuits supply, in particular, at least one electric quantity having a high accuracy and stability that can be used in general as reference in several circuit blocks, such as for example, analogue/digital converters, voltage regulators, detection and/or measurement circuits, etc.

A voltage reference should thus be strong for the applications it is intended for and in particular be characterized by a good thermal stability and by a good noise rejection, so as to supply a constant output voltage value independent from the variations of the supply voltage and of the working temperature of the integrated circuit comprising it.

To this purpose, circuits are commonly used for generating a voltage reference of the band-gap type, or more simply band-gap generators, wherein, the potential jump of the silicon prohibited band (about 1.1 eV) is exploited for generating an accurate voltage reference independent from the working temperature.

In particular, such a band-gap generator arises from the realization that a voltage VBG almost independent from the working temperature can be obtained in a simple way by means of a bipolar transistor by implementing the following equation:

$$VBG=VBE+nVT \quad (1)$$

VBG being the voltage reference independent from the temperature, or of band-gap, VBE being the voltage between the base and emitter terminals of the bipolar transistor used, VT being the thermal voltage (equal to kT/q, k being the Bolzmann constant, T being the absolute temperature and q being the electron charge) and n being a multiplicative parameter calculated to obtain the desired compensation of the variations in temperature of the voltage VBE.

The voltage VBE between base and emitter of a bipolar transistor decreases when the temperature increases (~−2.2 mV/° C.@T=300° K), while the thermal voltage VT is proportional to the temperature itself. In other words, a voltage (VBE) is to be compensated which decreases with the absolute temperature, i.e., it is CTAT (Complementary To Absolute Temperature) with a corrective coefficient (nVT) which is proportional to the absolute temperature or PTAT (Proportional To Absolute Temperature).

To obtain a voltage reference independent from the temperature one determines the value of the parameter n for which the derivative of the band-gap voltage VBG, with respect to the temperature, is equal to zero considering a temperature T=T* equal to a desired working temperature. For example if a null variation of the band-gap voltage reference VBG is to be obtained at the temperature of 27° C., a value of about 1.26V for VBG is found, the voltage VBE being at environment temperature equal to about 0.6V and the parameter n equal to about 26.

A band-gap generator may be realized in full CMOS technology realising the bipolar transistors by means of parasitic diodes. A possible implementation using an operational amplifier is shown in FIG. 1.

In particular, FIG. 1 shows a generator 1 of a band-gap voltage reference VBG. This generator 1 comprises an operational amplifier 2 inserted between a first and a second voltage reference, in particular a supply voltage reference VDD and a ground GND.

The operational amplifier 2 has a first input terminal T1, in particular an inverting one (−), and a second input terminal T2, in particular a non inverting one (+), as well as an output terminal, corresponding to the output terminal OUT of the generator 1, where the band-gap voltage reference VBG is supplied.

The generator 1 also comprises a bipolar stage 3 inserted between the output terminal OUT of the operational amplifier 2 and the ground GND and comprising a first Q1 and a second bipolar transistor Q2, as well as a first R1, a second R2, and a third resistive element R3.

More in particular, the first bipolar transistor Q1 is inserted between the second input terminal T2 of the operational amplifier 2 and the ground GND and has a control or base terminal coupled to the base terminal of the second bipolar transistor Q2 and both coupled to ground (both the bipolar transistors are diode-connected). The bipolar transistor Q2 is also coupled, through the first resistive element R1, to the first input terminal T1 of the operational amplifier 2 as well as to the ground GND.

The second input terminal T2 of the operational amplifier 2 is also feedback connected to its output terminal OUT, by means of the second resistive element R2 and the first input terminal T1 of the operational amplifier 2 is similarly feedback connected to its output terminal OUT, by means of the third resistive element R3.

It is to be noted that the operational amplifier 2 performs the double function of realizing a current proportional to the thermal voltage VT and of ensuring the output supply of a band-gap voltage reference VBG with low impedance, which is desirable, when the generator 1 should supply current.

Thanks to the presence of the operational amplifier 2 it is possible to assume that the voltage values on its input terminals T1 and T2 are identical ($V^+=V^-$), by putting $A_{E2}=kA_{E1}$, $A_{E2}$, $A_{E1}$ being the areas of the emitter terminals of the first and second bipolar transistors Q1 and Q2, respectively and k being a suitable project parameter calculated to obtain the desired temperature compensation.

Observing moreover that R2*IC1=R3*IC2, R2 and R3 being the resistive values of the second and third resistive elements R2 and R3, respectively, and IC1, IC2 the collector currents of the first and second bipolar transistors Q1 and Q2, respectively, the following is obtained:

$$I_{C2} = \frac{V_T}{R_2}\ln\left(\frac{R_3}{R_2}k\right) \tag{2}$$

Wherefrom the expression of the band-gap voltage reference VBG is easily derived:

$$V_{BG} = V_{EB1} + \frac{R_3}{R_1}V_T\ln\left(\frac{R_3}{R_2}k\right) \tag{3}$$

$V_{EB1}$ being the voltage between the base and emitter terminals of the first bipolar transistor Q1 and R1, R2, R3 the resistive values of the first, second and third resistive elements.

It is to be noted that the minimum value of the supply voltage reference VDD of the generator 1 under examination depends on the effective physical realization of the operational amplifier 2, but it results in any case limited below by the reference voltage value calculated for having a null variation at the environment temperature, equal to about 1.26V, as above indicated.

The generator 1 realized by means of the operational amplifier 2 and shown in FIG. 1 cannot thus be used in applications having supply voltages lower than about 1.3V.

It is also possible to modify the generator 1 to adapt it to applications with supply voltage lower than 1.3V and to obtain the generator 5 shown in FIG. 2, also inserted between a first and a second voltage reference, in particular a supply voltage reference VDD and a ground GND and having an output terminal OUT where the band-gap voltage reference VBG is supplied.

The generator 5 also comprises an operational amplifier 2 having a first input terminal T1, in particular an inverting one (−), and a second input terminal T2, in particular a non inverting one (+), as well as an output terminal OUT.

The generator 5 further comprises an input stage 6 inserted between the input terminals, T1 and T2, of the operational amplifier 2 and the ground GND, in turn including a first Q1 and a second bipolar transistor Q2, as well as a first R1, a second R2, and a third resistive element R3.

More in particular, the first bipolar transistor Q1 is inserted, in series with the first resistive element R1, between the first input terminal T1 of the operational amplifier 2 and the ground GND and has a control or base terminal coupled to the ground GND.

Similarly, the second bipolar transistor Q2 is in turn inserted, in series with the second and the third resistive element R2, R3, between the second input terminal T2 of the operational amplifier 2 and the ground GND and has a control or base terminal coupled to the ground GND.

The generator 5 also comprises a current mirror 7, inserted between the supply voltage reference VDD and an inner circuit node X' and coupled to the input terminals T1, T2 of the operational amplifier 2, as well as with its output terminal OUT and including a first, a second and a third MOS transistor, M1, M2 and M3 as well as a first capacitor C1.

More in particular, the first MOS transistor M1 is inserted between the supply voltage reference VDD and the first input terminal T1 of the operational amplifier 2 and has a control or gate terminal coupled to the control or gate terminal of the second MOS transistor M2, and both coupled to the output terminal OUT of the operational amplifier, the second MOS transistor M2 being in turn inserted between the supply voltage reference VDD and the second input terminal T2 of the operational amplifier 2. Similarly the third MOS transistor M3 is inserted between the supply voltage reference VDD and the inner circuit node X' and has the control or gate terminal coupled to the output terminal OUT of the operational amplifier 2 as well as with the bulk terminal of the second MOS transistor M2.

Finally, the first capacitor C1 of the current mirror 7 is inserted between the supply voltage reference VDD and the output terminal OUT of the operational amplifier 2.

In this way, the current mirror 7 is able to supply the inner circuit node X' with a value of current IP1 proportional to the current flowing in the first bipolar transistor Q1 of the input stage 6.

The generator 5 also comprises an output stage 8 inserted between the inner circuit node X' and the ground GND and coupled to the output terminal OUT' of the generator 5 and comprising a third bipolar transistor Q3, a fourth and a fifth resistive element R4 and R5 and a second capacitor C2.

More in particular, the fourth resistive element R4 and the third bipolar transistor Q3 are inserted, in series with each other, between the inner circuit node X' and the ground GND, the third bipolar transistor Q3 also having a control or base terminal in turn coupled to the ground GND. Similarly, the fifth resistive element R5 and the second capacitor C2 are inserted, in parallel to each other, between the inner circuit node X' and the ground GND.

It is to be noted that the voltage values on the input terminals T1 and T2 of the operational amplifier 2 being equal ($V^+=V^-$) and having:

$A_{E2}=nA_{E1}$, $R_1=R_3$, $I_{P1}=k_1I_P$ being:

$A_{E2}$, $A_{E1}$ the areas of the emitter terminals of the first and second bipolar transistors Q1 and Q2, respectively, of the input stage 6 and n a suitable multiplicative coefficient calculated to obtain the desired compensation in temperature, $R_1$, $R_3$ the resistance values of the first and of the second resistive element of the input stage 6, and $I_P$, $I_{P1}$ the current values flowing in the first bipolar transistor Q1 of the input stage 6 and in correspondence with the inner circuit node X' at the output of the current mirror 7, respectively, and $k_1$ a suitable multiplicative coefficient introduced by the dimensional ratio of the transistors M1 and M3 of this current mirror 7 with simple mathematical expressions, it is possible to obtain the following expression of the band-gap voltage reference VBG:

$$V_{BG} = \frac{R_5}{R_5 + R_4}\left(V_{EB3} + \frac{R_4}{R_2}V_T K_1 \ln\left(\frac{I_{S2}}{I_{S1}}\right)\right) \tag{4}$$

being:

$R_2$ the resistance value of the second resistive element of the input stage 6, $R_4$, $R_5$ the resistance values of the fourth and fifth resistive elements of the output stage 8, $V_{EB3}$ the voltage value between the base and emitter terminals of the third bipolar transistor Q3 of the output stage 8; and $I_{S1}$, $I_{S2}$ the inverse saturation current values of the first and second bipolar transistors Q1 and Q2, respectively.

It thus occurs that the resistive elements R1 and R3 are suitable for ensuring that signals at the input of the operational amplifiers 2 are adequate also at high temperatures, when the voltage value between the base and emitter terminals $V_{EB}$ of the bipolar transistors is low.

In fact, it is to be noted that the differential pair with which the operational amplifier is realized (not shown in the figure), for applications with low supply voltage values, should be of the n-channel type since a pair of p-channel transistors would be off for values of the supply voltage below about 1.4V. The resistive elements R1 and R3 put in series with the bipolar transistors Q1 and Q2 have the function of allowing a correct operation range at the input terminals T1 and T2 of the operational amplifier 2, substantially increasing by a certain amount the voltage value at the input terminals T1 and T2 of the operational amplifier 2, since the voltage VBE of these bipolar transistors Q1 and Q2 at high temperatures decreases too much for ensuring the turn-on of the n-channel transistors.

In this way, the generator 5 is able to offer good performances down to values of the supply voltage equal to about 1.1V.

However, for lower supply voltage values, and especially at low temperatures, when the voltage value between the base and emitter terminals $V_{EB}$ of the bipolar transistors is high, it may occur that the first and the second MOS transistors M1 and M2 of the current mirror 7 operate with a very low voltage value between the source and drain terminals Vds, and in particular quite different from the voltage value between the source and drain terminals Vds of the third MOS transistor M3, this latter voltage being considered constant for the whole temperature range.

These different operative conditions may cause mirroring errors of the currents, which may result in a poor behavior of the generator 5 when the temperature varies.

SUMMARY

An embodiment of the present disclosure is providing a generator circuit of a voltage reference independent from the temperature and having such structural and functional characteristics as to allow to overcome limits and drawbacks still affecting the generators realized according to the prior art and in particular, in the case of applications with low values of the supply voltage, to ensure that the voltage value applied to the input terminals of the operational amplifier contained in the band-gap generator is enough to ensure the turn-on of its input n-channel pair.

An embodiment of the present disclosure suitably and dynamically drives the control terminals of bipolar transistors coupled to the input terminals of the operational amplifier of the band-gap generator contained in the generator circuit of a temperature-compensated voltage reference so as to maintain a voltage value applied across this operational amplifier as constant as possible when the temperature varies, thus obtaining a correct common mode voltage range applied to these input terminals and thus a correct operation of its input n-channel pair for very low values, in particular lower than 1V, of the supply voltage.

More in particular, an embodiment of the disclosure generates a base biasing voltage which depends on the temperature in an inverse way with respect to the base-emitter voltage of the bipolar transistors coupled to the input terminals of the operational amplifier of the band-gap circuit and is summed thereto to compensate its variations with the temperature and obtain at the input terminals of this operational amplifier a voltage having a suitable value in the whole temperature range.

BRIEF DESCRIPTION OF THE DRAWINGS

Characteristics and advantages of the circuit and of the method according to one or more embodiments of the disclosure will be apparent from the following description given by way of indicative and non limiting example with reference to the annexed drawings.

In these drawings.

DETAILED DESCRIPTION

Figure 3A:
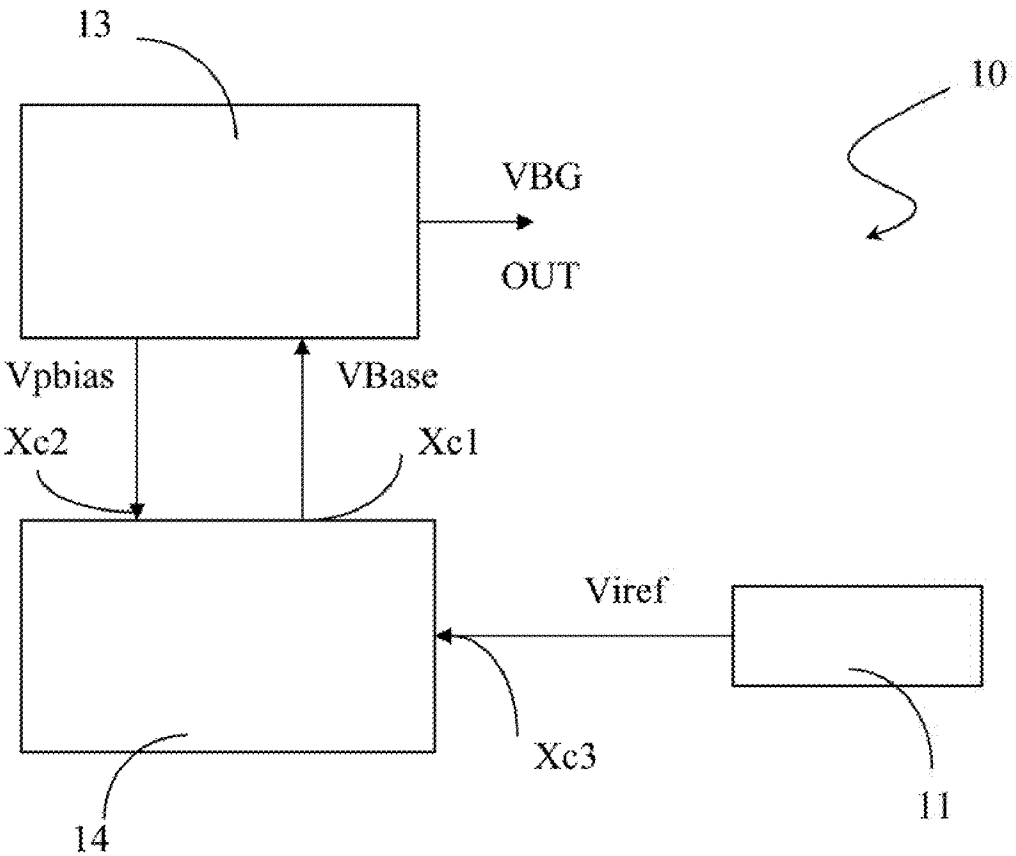
FIG. 3A schematically shows a circuit for generating a temperature-compensated voltage reference realized according to an embodiment of the disclosure.

With reference to these figures, and in particular to FIG. 3A, a circuit generating a temperature-compensated voltage reference, in particular using a band-gap voltage, is schematically and globally indicated with 10, hereafter simply indicated as generator 10.

The generator 10 comprises a generator circuit 13 of a band-gap voltage VBG, indicated as band-gap circuit 13. As seen in relation to FIG. 2, the band-gap circuit 13 comprises an operational amplifier having at least one first and one second bipolar transistor coupled to the input terminals of this operational amplifier and an output terminal OUT. This operational amplifier also comprises, coupled to these input terminals, a pair of differential MOS n-channel transistors.

An embodiment of the band-gap circuit 13 is coupled, in correspondence with a first and a second control node, Xc1 and Xc2, with a control block 14. In particular, the control block 14 is suitable for imposing, in correspondence with the first control node Xc1, a first biasing voltage value VBase on the base terminals of the bipolar transistors of the band-gap circuit 13, in particular, such a voltage value that, added to the voltage value between the base and emitter terminals, $V_{BE}$, of these bipolar transistors, an adequate common mode voltage is obtained being able to ensure the correct operation of the operational amplifier in the band-gap circuit 13 and in particular the turn-on of its differential pair of input n-channel MOS transistors. Moreover, the control block 14 receives, in correspondence with the second control node Xc2, a second biasing voltage value Vpbias. As it will be clear hereafter in the description, according to an embodiment of the disclosure, the control block 14 imposes a biasing voltage value having at least one component which increases with the temperature T to compensate the variations of the voltage between the base and emitter terminals $V_{BE}$. Moreover, from the sum of these voltages, an amount is deducted constant with the temperature T to add a substantially fixed base to the voltage value as obtained and thus suitably fix the common mode voltage level at the input terminals of the operational amplifier.

According to an embodiment of the disclosure, the generator 10 also comprises a reference block 11 coupled to a third control node Xc3 of the control block 14 and supplying it with a voltage value substantially constant with the temperature, Viref.

In an embodiment of the disclosure, the reference block 11 generates a current value constant with the temperature, Iref, starting from the value of the band-gap voltage VBG generated by the band-gap circuit 13, which is mirrored through a reference voltage Viref.

Figure 3B:
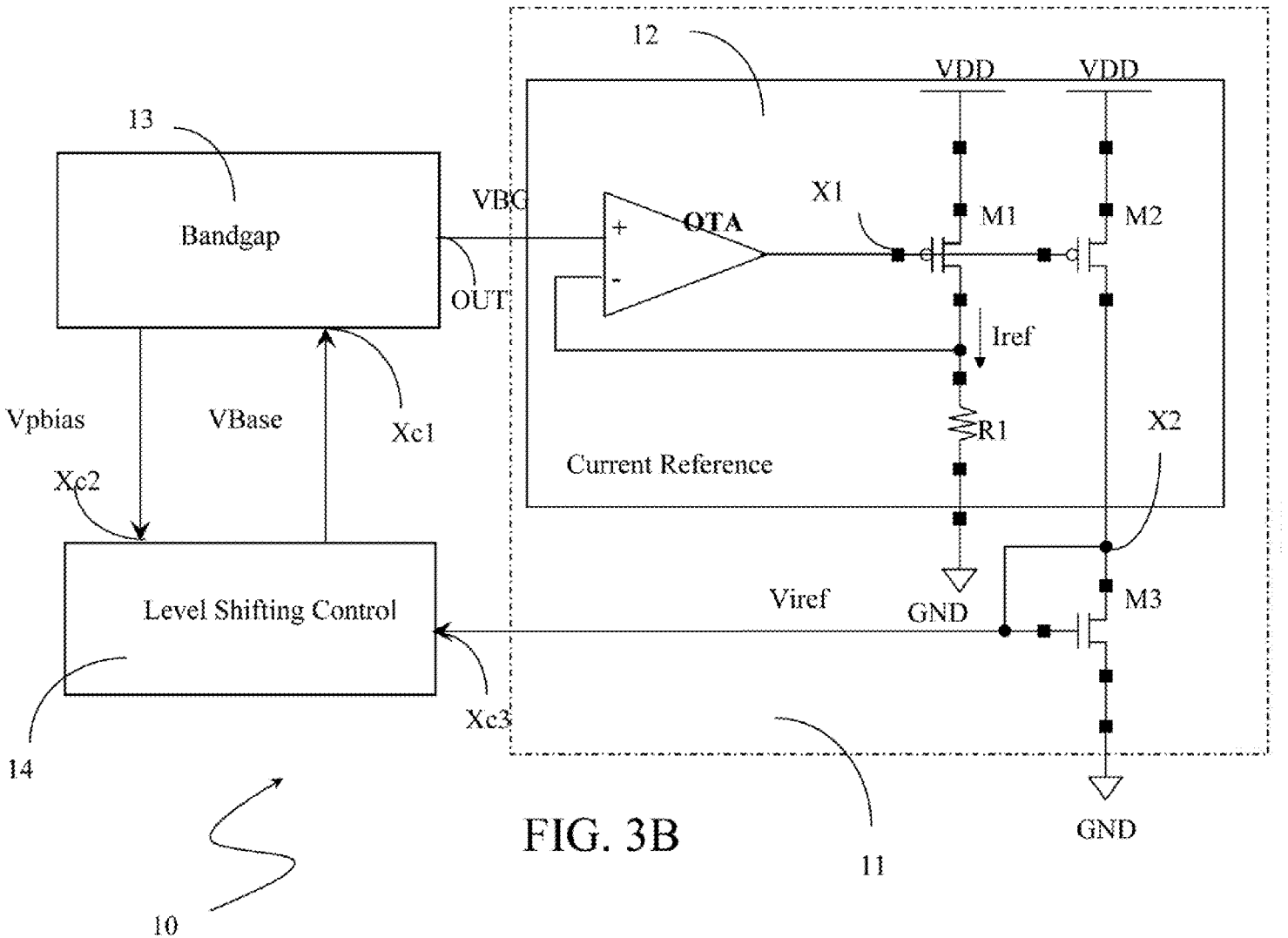
FIG. 3B schematically and in further detail shows the circuit of FIG. 3A.

In this case, as schematically shown in FIG. 3B, the reference block 11 is inserted between a first and a second voltage reference, in particular a supply voltage reference VDD and a ground GND and includes a current reference 12 in turn including an operational amplifier OTA (transconductance amplifier).

The operational amplifier OTA has a first input terminal, in particular an inverting one (−), and a second input terminal, in particular a non-inverting one (+) as well as an output terminal coupled to a first inner circuit node X1. The second input terminal of the operational amplifier OTA is suitably coupled to the output terminal OUT of the band-gap circuit 13 and receives there from the band-gap voltage VBG.

In particular, the current reference 12 further comprises a first and a second MOS transistor, M1 and M2, and a first resistive element R1. The first MOS transistor M1 is inserted between the supply voltage reference VDD and the first input terminal of the operational amplifier OTA and has a control or gate terminal coupled to the first inner circuit node X1, as well as to a control or gate terminal of the second MOS transistor M2, in turn inserted between the supply voltage reference VDD and a second inner circuit node X2. The first resistive element R1 is in turn coupled between the first inner circuit node X1 and the ground GND.

Moreover, the reference block 11 comprises a third MOS transistor M3 inserted between the second inner circuit node X2 at the output of the current reference 12 and the ground GND and having a control or gate terminal diode-connected to the second inner circuit node X2. In this way, the third MOS transistor M3 realises a mirror of a reference current Iref, this mirror mirroring a reference current Iref flowing in the first resistive element R1 and converting it into the reference voltage value Viref, supplying it to the third control node Xc3 of the control block 14.

It is to be noted that this reference current Iref is obtained starting from the band-gap voltage VBG on a resistance R1 and is thus stable in temperature.

In the embodiment shown in FIG. 3B, the first and second transistors M1 and M2 are PMOS transistors and the third transistor M3 is an NMOS transistor.

Figure 4:
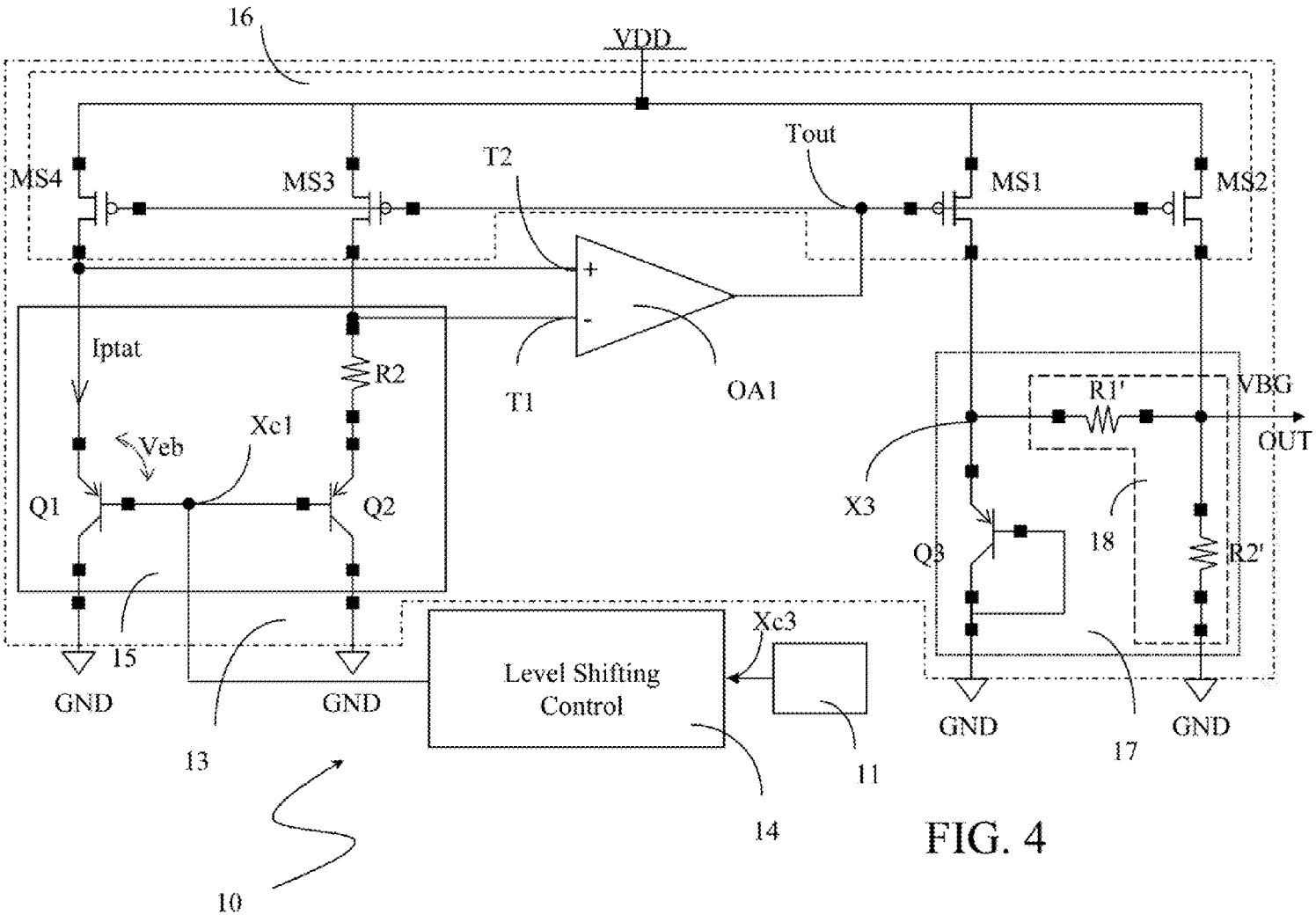
FIG. 4 schematically and in further detail shows the circuit of FIG. 3A.

The generator 10 according to an embodiment of the disclosure is shown in greater detail in FIG. 4 and in particular the band-gap circuit 13, controlled by the control block 14.

As previously seen, the generator 10 thus comprises the band-gap circuit 13 coupled to the control block 14 in correspondence with the first and second control nodes, Xc1 and Xc2, as well as to the reference block 11 in correspondence with the third control node Xc3.

The band-gap circuit 13 comprises an operational amplifier OA1 having a first input terminal T1, in particular an inverting one (−) and a second input terminal T2, in particular a non-inverting one (+), as well as an output terminal Tout.

Figure 1:
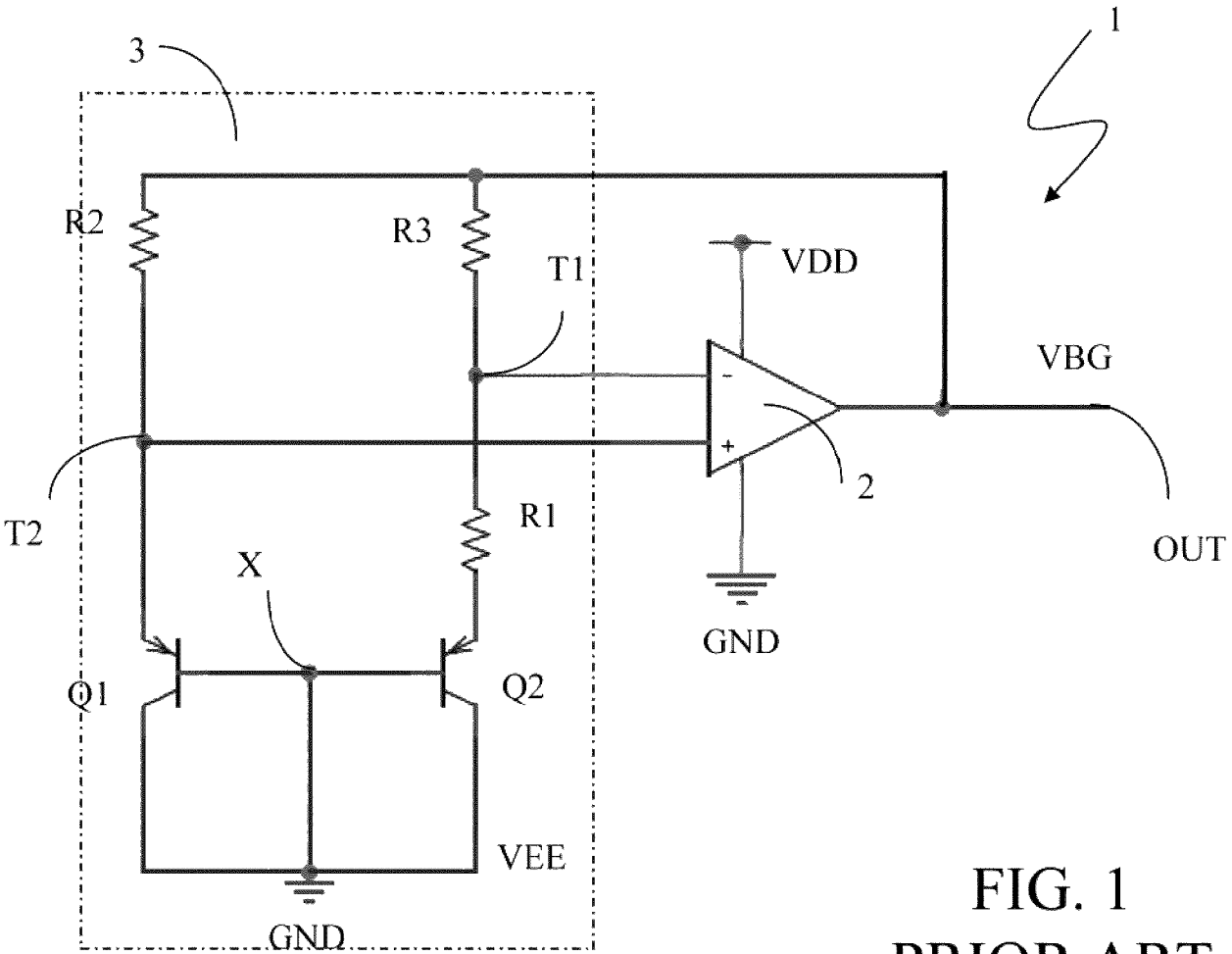
FIG. 1 PRIOR ART
FIG. 1 schematically shows a possible circuit implementation of a generation circuit of a band-gap voltage reference realized according to the prior art.
Figure 2:
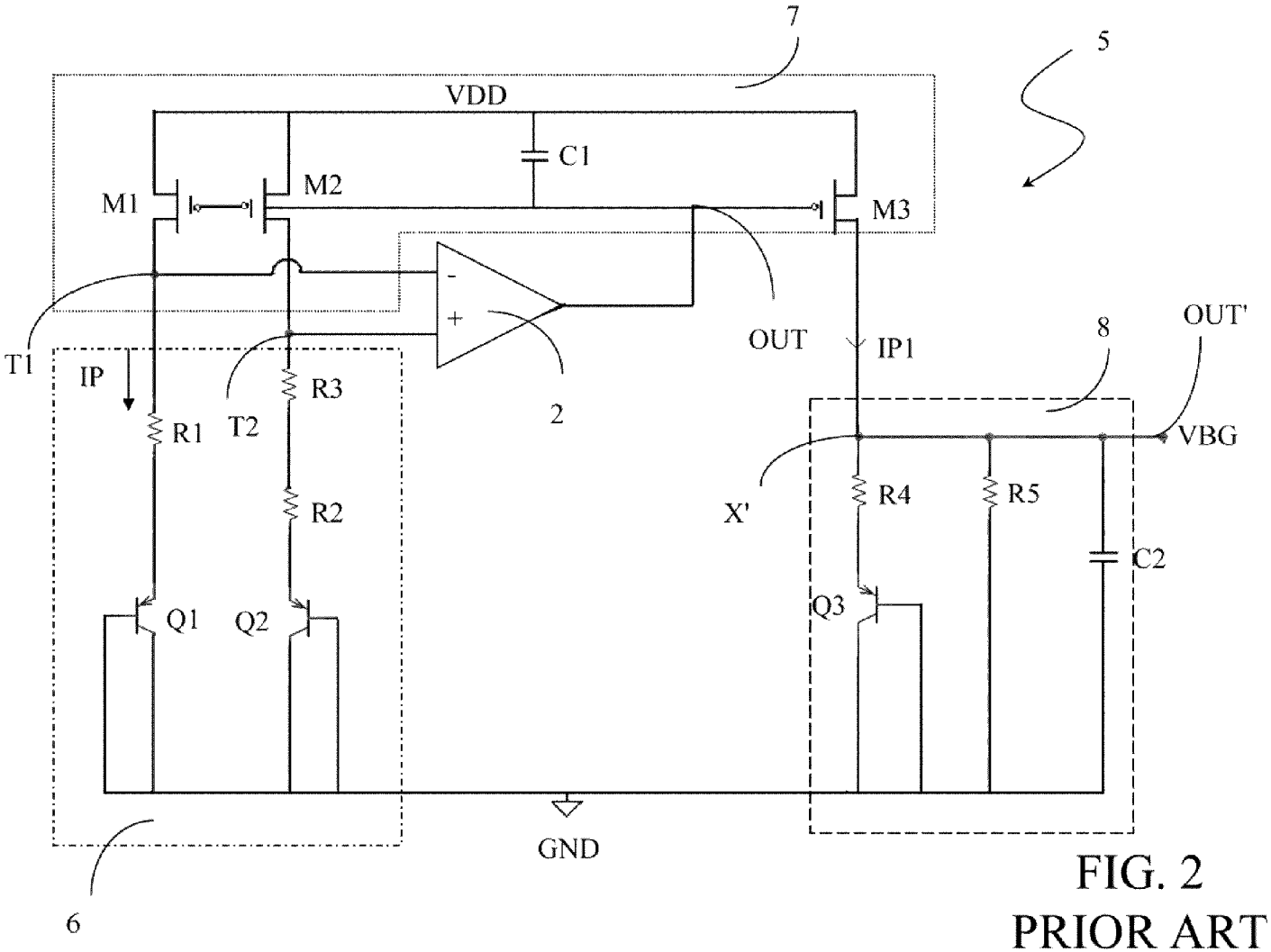
FIG. 2 PRIOR ART
FIG. 2 schematically shows a further implementation of a generator circuit of a band-gap voltage reference realized according to the prior art and suitable for applications with low supply voltages.

More in particular, the first and second input terminals, T1 and T2, are coupled, as seen in relation with FIG. 2, to an input stage 15 comprising a first and a second bipolar transistor, Q1 and Q2, and a second resistive element R2. The first bipolar transistor Q1 is inserted between the second input terminal T2 of the operational amplifier OA1 and the ground GND and has a control or base terminal coupled, in correspondence with the first control node Xc1, to the control or base terminal of the second bipolar transistor Q2. Moreover, the second resistive element R2 and the second bipolar transistor Q2 are inserted, in series with each other, between the first input terminal T1 of the operational amplifier OA1 and the ground GND.

According to an embodiment of the disclosure, the common base terminals of the first and second bipolar transistors, Q1 and Q2, of the input stage 15 are coupled to the control block 14 and receive there from the first biasing voltage value VBase.

Further, the band-gap circuit 13 comprises a current mirror 16 coupled to the input and output terminals of the operational amplifier OA1 and comprising a first, a second, a third and a fourth mirror MOS transistor, MS1, MS2, MS3 and MS4.

In particular, the first mirror MOS transistor MS1 is inserted between the supply voltage reference VDD and a third inner circuit node X3 and has a control or gate terminal coupled to the output terminal Tout of the operational amplifier OA1 and to the control or gate terminal of the second mirror MOS transistor MS2, in turn inserted between the supply voltage reference VDD and the output terminal OUT of the band-gap circuit 13, corresponding to the output terminal of the generator 10. Similarly, the third and fourth mirror MOS transistors MS3 and MS4 are inserted between the supply voltage reference VDD and the second and first input terminals T2 and T1 of the operational amplifier OA1, respectively, and have respective control or gate terminal coupled to each other and to the output terminal Tout of the operational amplifier OA1. In the embodiment shown in FIG. 4, the mirror transistors MS1, MS2, MS 3 and MS 4 are PMOS transistors.

Moreover, the band-gap circuit 13 comprises an output stage 17 coupled to the output terminal OUT. In particular, the output stage 17 comprises in turn a third bipolar transistor Q3 inserted between the third inner circuit node X3 and the ground GND and having the control or base terminal coupled to the ground GND, as well as a resistive divider 18 including a first resistive element R1' coupled between the third inner circuit node X3 and the output terminal OUT and a second resistive element R2' coupled between the output terminal OUT and the ground GND.

It is to be noted that the output stage 17, and in particular the resistive divider 18, allows one to fix the value of the band-gap voltage VBG obtained at the output terminal OUT to the desired value, for example equal to 0.65V.

It is possible to consider other configurations for the output stage 17, in particular with the third bipolar transistor Q3 inserted in series with the first resistive element R1' between the output terminal OUT and the ground GND, in parallel with the second resistive element R2'.

As previously said, according to an embodiment of the disclosure, the common base terminal of the bipolar transistors Q1 and Q2 is coupled to the first control node Xc1 of the control block 14 suitable for imposing a first biasing voltage value VBase, in particular, such a voltage value that, added to the voltage value between the base and emitter terminals, $V_{BE}$, of these bipolar transistors, an adequate common mode voltage is obtained being able to ensure the correct operation of the operational amplifier OA1, in particular suitable for ensuring the turn-on of the pair of input n-channel MOS transistors of this operational amplifier OA1.

It is in fact to be remembered that it may be desirable the common mode voltage applied to the input terminals of the operational amplifier OA1 differ as little as possible with respect to the band-gap output voltage VBG for consequently reducing the systematic error introduced by the current mirror 16, in particular comprising MOS transistors of the P type, due to the so called Early effect.

Figure 5:
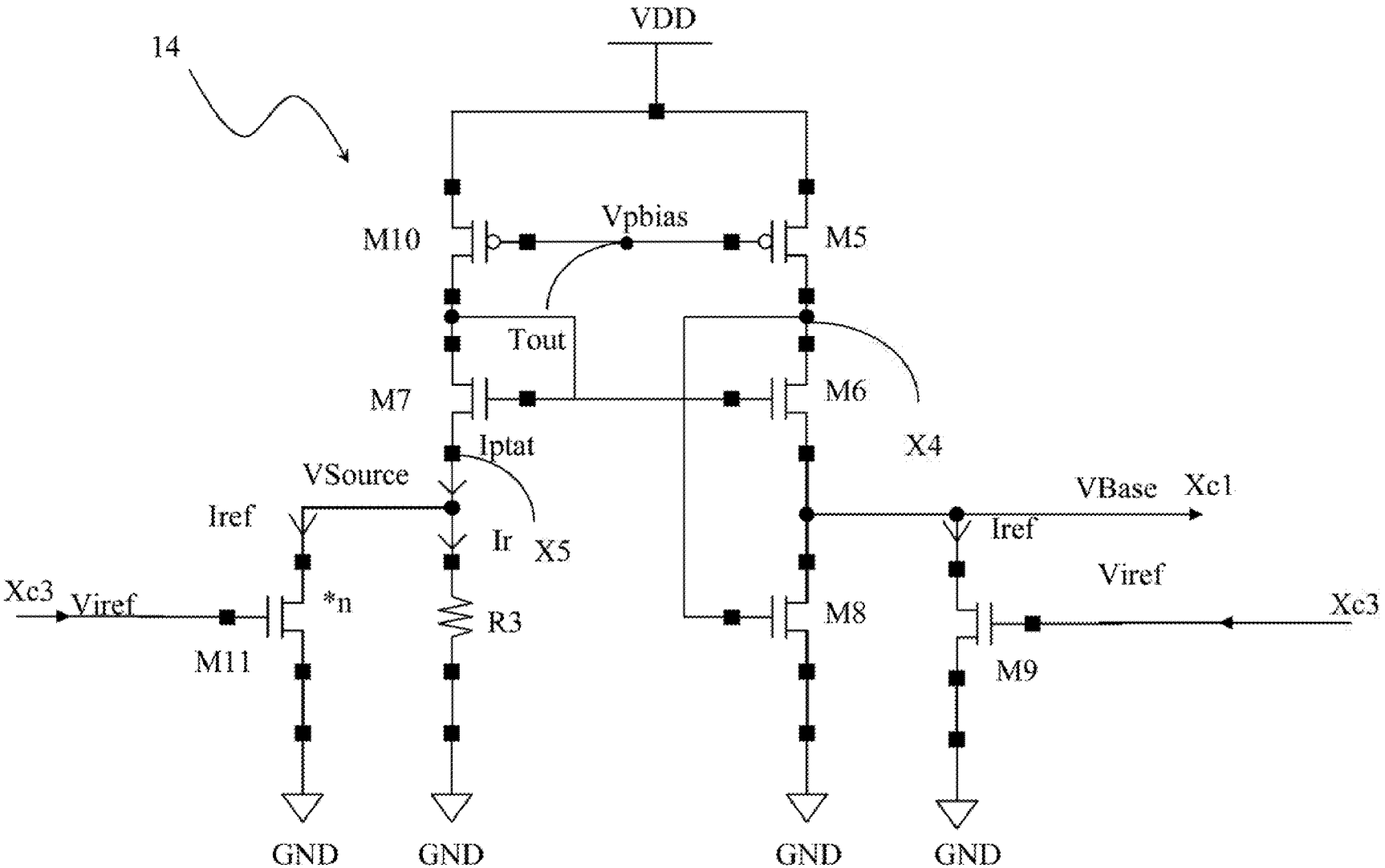
FIG. 5 schematically shows a detail of the circuit of FIG. 3A.

This nullifying effect of the current mirror is obtained, advantageously according to an embodiment of the disclosure, by the control block 14 shown in greater detail in FIG. 5.

In particular, the control block 14 is inserted between the supply voltage reference VDD and the ground GND and has an input terminal in correspondence with the third control node Xc3 and an output terminal in correspondence with the first control node Xc1.

The control block 14 comprises a first and a second MOS transistor, M5 and M6, inserted, in series with each other, between the supply voltage reference VDD and the first control node Xc1 and interconnected in correspondence with a fourth inner circuit node X4, as well as a third and a fourth MOS transistor, M10 and M7, inserted, in series with each other, between the supply voltage reference VDD and a fifth inner circuit node X5.

More in particular, the first transistor M5 is a PMOS transistor and has a control or gate terminal coupled, in correspondence with the terminal Tout, which is the output terminal of the operational amplifier OA1 of FIG. 4, with the control or gate terminal of the third transistor M10, also a PMOS transistor. Moreover, the second transistor M6 is an NMOS transistor and has a control or gate terminal coupled to the control or gate terminal of the fourth transistor M7, also an NMOS transistor and diode-connected.

The control block 14 further comprises a fifth and a sixth MOS transistor, M8 and M9, inserted, in parallel to each other, between the first control node Xc1 and the ground GND. In particular, the fifth transistor M8 is an NMOS transistor and has a control or gate terminal coupled to the fourth inner circuit node X4, while the sixth transistor M9 is an NMOS transistor and has a control or gate terminal coupled to the third control node Xc3.

The control block 14 also comprises a seventh MOS transistor M11 and a resistive element R3 inserted, in parallel to each other, between the fifth inner circuit node X5 and the ground GND. In particular, the seventh transistor M11 is an NMOS transistor having a control or gate terminal coupled to the third control node Xc3.

As previously seen, the control block 14 receives on the third control node Xc3 a reference voltage value Viref supplied by the reference block 11.

According to an embodiment of the disclosure, the control block 14 supplies to the first control node Xc1 a first biasing voltage value VBase, which is substantially equal to the voltage value VSource being at the fifth inner circuit node X5 and substantially equal to:

$$V\text{Source}=V\text{Base}=(\Delta Veb/R2-n*VBG/R1)*R3 \quad (5)$$

In fact, it is immediate to verify that, in the branch comprising the transistors M7 and M10, a current Iptat flows substantially equal to ΔVeb/R2, ΔVeb being the difference between the two base-emitter voltages Veb of the two bipolar transistors Q1 and Q2 of the input stage 15, which is divided into a first current proportional to the reference current Iref which flows in the branch comprising the seventh transistor M11 and a second current Ir which flows in the branch comprising the resistive element R3. Moreover, also in the branch comprising the sixth transistor M9 a current flows proportional to the reference current Iref. The value of the first current Iref is obtained by the reference block 11 starting from the band-gap voltage VBG and is equal to Iref=VBG/R1, R1 being the resistive element of the current reference 12 shown in FIG. 3B.

The size of the seventh transistor M11 is chosen so as to be equal to n times the size of the sixth transistor M9, n being a suitably chosen multiplicative parameter.

In this way, the common mode voltage Vcommon applied to the input terminals T1 and T2 of the operational amplifier 12 is given by $$V\text{common}=Veb+\Delta Veb*(R3/R2)-n*VBG*(R3/R1) \quad (6)$$

being

Veb the voltage value between the emitter and base terminals of the first bipolar transistor Q1 of the input stage 15 and ΔVeb the difference between the two base-emitter voltages Veb of the two bipolar transistors Q1 and Q2 of the input stage 15;

VBG the band-gap voltage value supplied by the band-gap circuit 13;

R1 the resistive value of the resistive element of the reference block 11;

R2 the resistive value of the resistive element coupled to the second bipolar transistor Q2 in the input stage 15; and R3 the resistive value of the resistive element of the control block 14.

In other words, according to an embodiment of the disclosure, the control block 14 allows to obtain a resulting voltage given by a first component which decreases with the temperature T (Veb) and by a second component which increases with the temperature T (ΔVeb*(R3/R2)), which compensates the variations of the first component, components from which a third component constant with the temperature T (n*VBG*(R3/R1)) is deducted. In particular, the third component allows to add a fixed base to the voltage value obtained and thus to suitably fix the common mode level at the input terminals of the operational amplifier.

Figure 6:
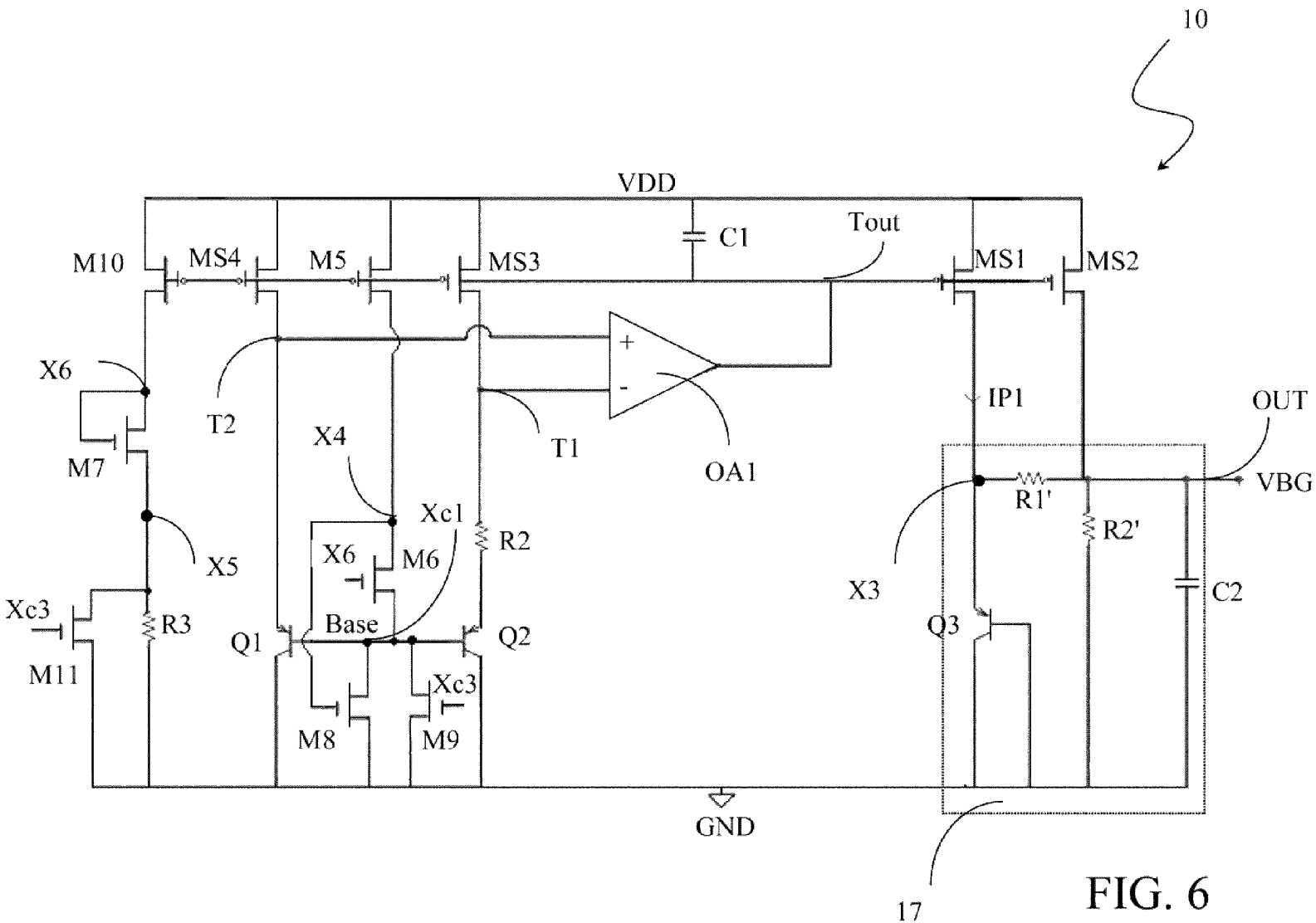
FIG. 6 schematically shows a possible circuit implementation of the generator circuit of a temperature-compensated voltage reference according to an embodiment of the disclosure.

The overall scheme of the generator 10 according to an embodiment of the disclosure is shown in FIG. 6, where, by way of simplicity, the illustration of the reference block 11 has been omitted and where a sixth inner circuit node X6 has been further indicated corresponding to the common gate terminals of the transistors M6 and M7.

According to an embodiment of the disclosure, as above explained, the generator 10 then supplies a band-gap voltage VBG reference sufficiently independent from the temperature and operable with supply voltages below 1V.

An embodiment of the disclosure also relates to a method for generating a temperature-compensated voltage reference VBG starting from a band-gap voltage obtained by a band-gap circuit 13 comprising an operational amplifier OA1 having the input terminals coupled to at least one first and one second bipolar transistor, Q1 and Q2.

The method thus comprises the steps of:

generating a first component of the temperature-compensated voltage reference which decreases with the temperature, as base-emitter voltage of one of said bipolar transistors, in particular of the first bipolar transistor Q1;

driving the base terminal of the first bipolar transistor Q1 by applying the biasing voltage value VBase supplied by the control block 14 coupled to this base terminal; and obtaining the temperature-compensated voltage value VBG on the output terminal OUT of the generator 10.

Suitably, the driving step provides that the control block 14 imposes to the base terminal of the first bipolar transistor Q1 a biasing voltage value VBase comprising at least one voltage component which increases with the temperature (ΔVeb*(R3/R2) to compensate the variations of the voltage (VBE) inversely proportional to the temperature obtained between the base and emitter terminals VBE of the first bipolar transistor Q1. In this way, as previously explained, the turn-on of the pair of n-channel input transistors of the operational amplifier OA1 is substantially ensured.

According to an embodiment of the disclosure, the driving step of the base terminal of the first bipolar transistor Q1 further generates a third subtractive component of the biasing voltage value constant with the temperature (n*VBG*(R3/R1) and able to add a fixed base to the voltage value obtained and thus a degree of freedom for the fixing of the common mode value at the input terminals of the operational amplifier.

One or more embodiments of the proposed generator 10 may find particular application in the memories for Smart Cards, and may also relate to a memory for Smart card of the type comprising at least one generator 10 of a temperature-compensated voltage reference as above described.

Figure 7:
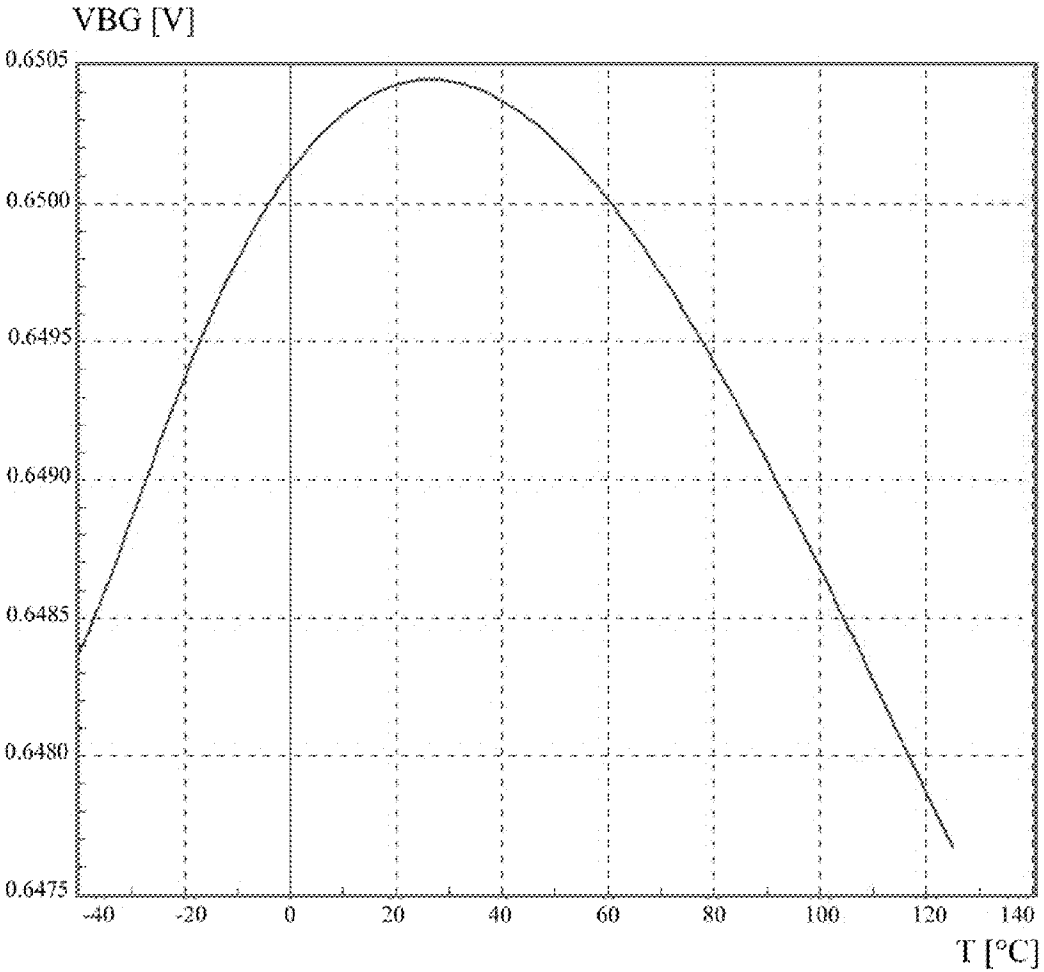
FIG. 7 shows the pattern of the temperature-compensated voltage reference obtained by a generation circuit according to an embodiment of the disclosure when the temperature varies.
Figure 8:
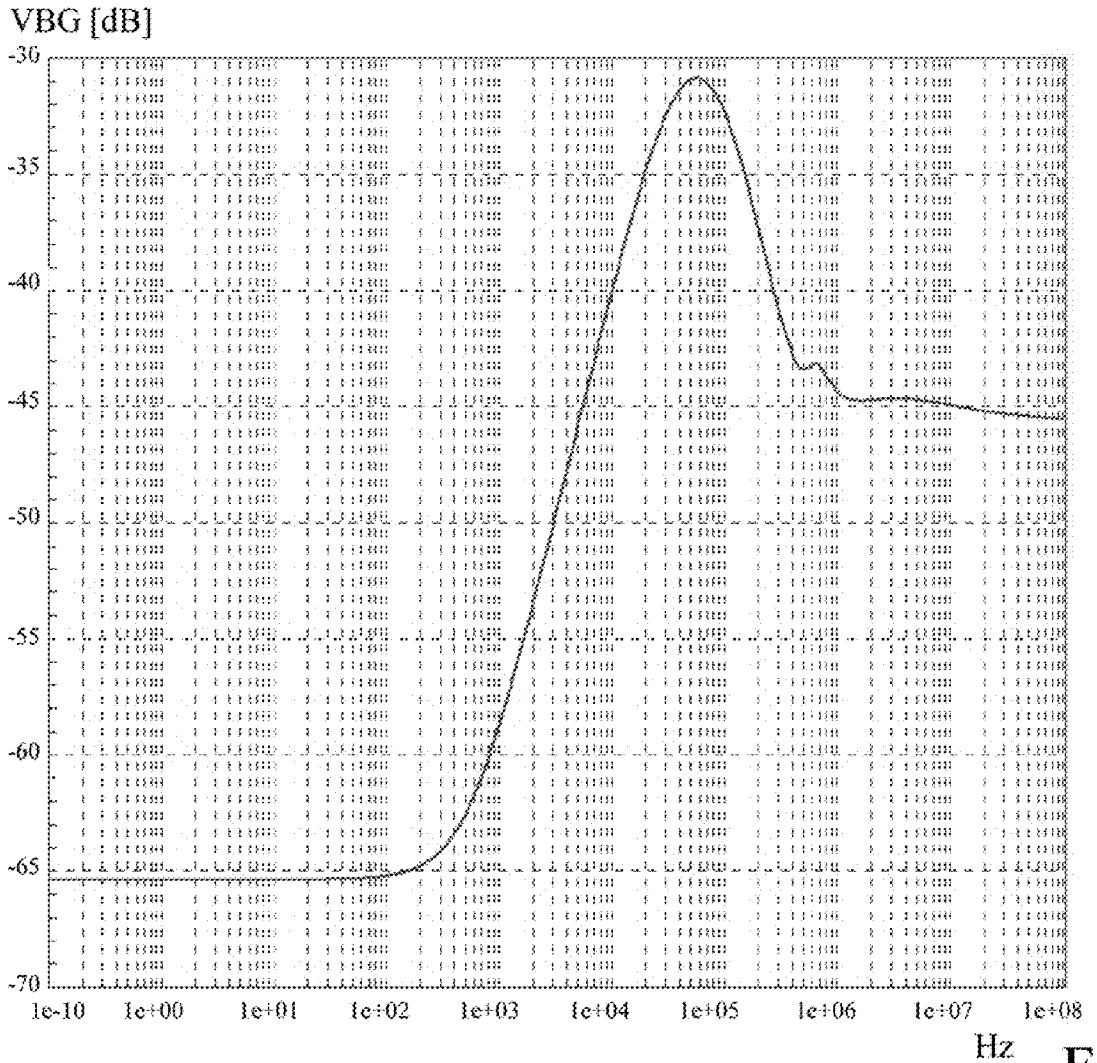
FIG. 8 shows the rejection analysis on the supply or PSRR (Power Supply Rejection Ratio) of a generation circuit according to an embodiment of the disclosure carried out with a supply voltage equal to 0.9V.

The results of experimental tests are shown in FIGS. 7 and 8.

In particular, FIG. 7 shows an analysis in temperature of the generator 10 according to an embodiment of the disclosure simulated with a supply voltage equal to 0.9V and making the temperature vary from −40° C. to 125° C.

As it can be noted, the global variation of the band-gap voltage VBG in the whole temperature range as considered is lower than 3 mV.

FIG. 8 reports a rejection analysis on the supply or PSRR (Power Supply Rejection Ratio) of the generator 10 carried out with a supply voltage equal to 0.9V. It then occurs that the generator 10 according to an embodiment of the disclosure ensures a PSRR value of about 65 dB at low frequencies and a worse case of about 31 dB at a frequency of 50 kHz.

In conclusion, a generator 10 according to an embodiment of the disclosure has the following advantages:

ensures a correct operation of the current reference also with supply voltages lower than 1V;

ensures a high rejection to the noise at the supply reference;

has good performances in terms of sensitivity to the variation of the supply voltage and of the temperature; and offers a good compensation in temperature of the voltage value as obtained.

Suitably, an implementation of the circuit according to an embodiment of the disclosure also takes into due consideration the area occupation, a parameter that may become more and more important when the technology evolves.

An embodiment of the generator 10 may be included in an integrated circuit (IC) such as a memory circuit, which may be included in a system such as a computer system. The IC may be coupled to another IC (e.g., a controller) of the system, and the IC's may be on the same or different dies.

Naturally, in order to satisfy local and specific requirements, a person skilled in the art may apply to the solution described above many modifications and alterations. Particularly, although the present disclosure has been described with a certain degree of particularity with reference to described embodiment(s) thereof, it should be understood that various omissions, substitutions and changes in the form and details as well as other embodiments are possible. Moreover, it is expressly intended that specific elements and/or method steps described in connection with any disclosed embodiment of the disclosure may be incorporated in any other embodiment as a general matter of design choice.

What is claimed is:

1. Circuit for generating a temperature-compensated voltage reference of the type comprising at least one generator circuit of a band-gap voltage, inserted between a first and a second voltage reference and including an operational amplifier, having in turn a first and a second input terminal connected to an input stage connected to said first and second input terminal and comprising at least one pair of a first and a second bipolar transistor for the generation of a first voltage component proportional to the temperature, a control block connected to said generator circuit of a band-gap voltage in correspondence with at least one control node coupled to a base of the first bipolar transistor, which is supplied with a value of biasing voltage comprising at least one voltage component which increases with the temperature for compensating the variations of the base-emitter voltage of said first and second bipolar transistor and ensuring the turn-on of a pair of input transistors of said operational amplifier, said circuit including a reference block in communication with another control node and coupled to the control block and configured to communicate a reference voltage constant with the temperature, the circuit further having an output terminal suitable for supplying a temperature-compensated voltage value obtained by the sum of said first voltage component proportional to the temperature and of a second component inversely proportional to the temperature.

2. Circuit according to claim 1, wherein said control block is connected to said generator circuit of a band-gap voltage in correspondence with a base terminal of said first bipolar transistor of said input stage.

3. Circuit according to claim 2, wherein said first bipolar transistor is connected between said second input terminal of said operational amplifier and said second voltage reference and said second bipolar transistor is connected, in series with a resistive element, between said first input terminal of said operational amplifier and said second voltage reference, characterized in that said control block is connected to said generator circuit of a band-gap voltage in correspondence with the common base terminals of said first and second bipolar transistors of said input stage.

4. Circuit for generating a temperature-compensated voltage reference of the type comprising at least one generator circuit of a band-gap voltage, inserted between a first and a second voltage reference and including an operational amplifier, having in turn a first and a second input terminal connected to an input stage connected to said first and second input terminal and comprising at least one pair of a first and a second bipolar transistor for the generation of a first voltage component proportional to the temperature, a control block connected to said generator circuit of a band-gap voltage in correspondence with at least one first control node which is supplied with a value of basing voltage comprising at least one voltage component which increases with the temperature for compensating the variations of the base-emitter voltage of said first and second bipolar transistor and ensuring the turn-on of a pair of input transistors of said operational amplifier, said circuit having an output terminal suitable for supplying a temperature-compensated voltage value obtained by the sum of said first voltage component proportional to the temperature and of a second component inversely proportional to the temperature;

wherein said control block is connected to said generator circuit of a band-gap voltage in correspondence with a base terminal of said first bipolar transistor of said input stage; and wherein said control block is further connected to a reference block in correspondence with a third control node, said reference block being suitable for supplying a reference current value constant with the temperature mirrored in a reference voltage value.

5. Circuit according to claim 4, wherein said control block comprises:

a first and a second MOS transistor inserted, in series with each other, between said first voltage reference and said first control node and interconnected in correspondence with an inner circuit node; and a third and a fourth MOS transistor inserted, in series with each other, between said first voltage reference and a further inner circuit node, said first transistor having a control terminal connected to a control terminal of said third transistor and said second transistor having a control terminal connected to a control terminal of said fourth transistor, in turn diode-connected, said common control terminals of said first and third transistors being connected to the output terminal of said operational amplifier.

6. Circuit according to claim 5, wherein said control block further comprises:

a fifth and a sixth MOS transistor inserted, in parallel to each other, between said first control node and said second voltage reference, said fifth transistor having a control terminal connected to said inner circuit node and said sixth transistor having a control terminal connected to said third control node; and a seventh MOS transistor and a resistive element inserted, in parallel to each other, between said further inner circuit node and said second voltage reference, said seventh transistor having a control terminal connected to said third control node.

7. Circuit according to claim 6, wherein said seventh MOS transistor has sizes equal to n times the sizes of said sixth transistor, n being a suitably chosen parameter.

8. Circuit according to claim 4, wherein said reference block generates said reference current value constant with the temperature starting from a band-gap voltage value generated by said generation circuit of a band-gap voltage, which is mirrored in said reference voltage value.

9. Circuit according to claim 8, wherein said reference block comprises a current reference in turn essentially including an operational amplifier having at least one input terminal connected to said generator circuit of a band-gap voltage and receiving there from said band-gap voltage value, as well as a first and a second transistor and a resistive element, wherein:

said first transistor being inserted between said first voltage reference and a further first input terminal of said operational amplifier and having a control terminal connected to said first inner circuit node, as well as to a control terminal of said second transistor;

said second transistor being inserted between said first voltage reference and a second inner circuit node and said resistive element being connected between said first inner circuit node and said second voltage reference.

10. Circuit according to claim 9, wherein said reference block further comprises a third transistor inserted between said second inner circuit node at the output of said current reference and said second voltage reference and having a control terminal diode-connected to said second inner circuit node for realizing a mirror of a reference current flowing in said resistive element and converting it into said reference voltage value to be supplied to said third control node of said control block.

11. Circuit according to claim 1, wherein said generator circuit of a band-gap voltage further comprises a current mirror connected to an output terminal of said operational amplifier and to said output terminal of said circuit.

12. Circuit according to claim 11, wherein said generator circuit of a band-gap voltage further comprises an output stage connected to said output terminal of said circuit and including at least one third bipolar transistor and a resistive divider, inserted between said output terminal and said second voltage reference to fix said temperature-compensated voltage value to a desired level.

13. Method for generating a temperature-compensated voltage reference, starting from a band-gap voltage obtained by a generator circuit of a band-gap voltage including an operational amplifier having input terminals connected to at least one pair of a first and a second bipolar transistor, the method comprising:

generating a component of said temperature-compensated voltage reference which increases with the temperature, as a difference of base-emitter voltages of said first and second bipolar transistors;

generating a current value constant with temperature that is mirrored in a reference voltage communicated to the generator circuit;

driving a base terminal of said first bipolar transistor by applying a biasing voltage value supplied by a control block connected to said base terminal; and obtaining said temperature-compensated voltage value as a sum of a first voltage component proportional to the temperature and a second component inversely proportional to the temperature, said driving providing that said control block imposes to said base terminal of said first bipolar transistor a biasing voltage value comprising at least said voltage component which increases with the temperature for compensating the variations of said first voltage component proportional to the temperature obtained between the base and emitter terminals of said first bipolar transistor and ensure the turn-on of a pair of input transistors of said operational amplifier.

14. Method according to claim 13, wherein said driving of said base terminal of said bipolar transistor further generates a third subtractive component of said temperature-compensated value constant with the temperature and able to add a fixed base to a voltage value obtained and thus a degree of freedom for the fixing of a desired value.

15. A reference generator, comprising:

an output stage operable to provide a reference signal having a substantially constant value over a temperature range;

an amplifier having an input node and having an output node coupled to the output stage;

an input stage coupled to the amplifier and operable to drive the input node with a drive signal; and a bias stage coupled to the input stage and operable to maintain the drive signal within a signal range over the temperature range, wherein the bias stage is responsive to a current value based on the band gap voltage that is mirrored through a reference voltage.

16. The reference generator of claim 15 wherein the bias stage is operable to maintain a temperature coefficient of the drive signal at substantially zero over the temperature range.

17. A reference generator, comprising:

an output stage operable to provide a reference signal having a substantially constant value over a temperature range;

a differential amplifier having first and second input nodes and having an output node coupled to the output stage;

an input stage coupled to the amplifier and operable to drive the first and second input nodes with respective first and second drive signals; and a bias stage coupled to the input stage and operable to maintain the first and drive signals within a signal range over the temperature range, the bias stage being responsive to a current value based on the band gap voltage that is mirrored through a reference voltage.

18. The reference generator of claim 17 wherein:

the reference signal comprises a reference voltage; and the input stage is operable to drive the first and second input nodes with respective first and second drive voltages, and the bias stage is operable to maintain the drive voltages within a voltage range over the temperature range.

19. The reference generator of claim 17 wherein the input stage comprises:

a first bipolar transistor having an emitter coupled to the first input node of the differential amplifier; and a second bipolar transistor having an emitter coupled to the second input node of the differential amplifier.

20. The reference generator of claim 17 wherein:

the input stage comprises a first bipolar transistor having a base and having an emitter coupled to the first input node of the differential amplifier, and a second bipolar transistor having a base and having an emitter coupled to the second input node of the differential amplifier; and the bias stage is coupled to the bases of the first and second bipolar transistors.

21. The reference generator of claim 17 wherein the differential amplifier comprises an operational amplifier.

22. The reference generator of claim 17 wherein:

the bias stage is operable to generate a bias signal; and the input stage is operable to generate the first and second drive signals in response to the bias signal.

23. The reference generator of claim 17 wherein:

the bias stage is operable to generate a bias signal having a temperature coefficient; and the input stage is operable to generate the first and second drive signals having substantially zero temperature coefficients in response to the bias signal.

24. The reference generator of claim 17 wherein the bias stage is operable to maintain the drive signals substantially constant over the temperature range.

25. The reference generator of claim 17 wherein the bias stage is coupled to the output stage and is operable to maintain the first and second drive signals within the signal range in response to the reference signal.

26. The reference generator of claim 17, further comprising a feedback circuit coupled to the output stage and to the bias stage.

27. The reference generator of claim 17 wherein:

the input stage comprises a first bipolar transistor having a base and having an emitter coupled to the first input node of the differential amplifier, and a second bipolar transistor having a base and having an emitter coupled to the second input node of the differential amplifier; and the bias stage is operable to generate on the bases of the first and second transistors a bias voltage that increases with temperature.

28. The reference generator of claim 17 wherein:

the input stage comprises a first bipolar transistor having a base operable to receive a bias voltage that increases with temperature, having an emitter coupled to the first input node of the differential amplifier, and operable to generate as the first drive signal a first drive voltage on the first input node, and a second bipolar transistor having a base operable to receive the bias voltage, having an emitter coupled to the second input node of the differential amplifier, and operable to generate as the second drive signal a second drive voltage on the second input node; and the bias stage is operable to generate the bias voltage.

29. The reference generator of claim 17 wherein:

the input stage comprises a first bipolar transistor having a base operable to receive a bias voltage that increases with temperature, having an emitter coupled to the first input node of the differential amplifier, and operable to generate as the first drive signal a first drive voltage on the first input node, and a second bipolar transistor having a base operable to receive the bias voltage, having an emitter coupled to the second input node of the differential amplifier, and operable to generate as the second drive signal a second drive voltage on the second input node such that the second drive voltage substantially equals the first drive voltage; and the bias stage is operable to generate the bias voltage.

30. The reference generator of claim 17 wherein the first drive signal substantially equals the second drive signal.

31. The reference generator of claim 17 wherein:

the input stage is operable to generate first components of the first and second drive signals having respective first and second temperature coefficients; and the bias stage is operable to cause the input stage to generate second components of the first and second drive signals respectively having third and fourth temperature coefficients, the first and third temperature coefficients being of opposite polarity, the second and fourth temperature coefficients being of opposite polarity.

32. The reference generator of claim 17 wherein:

the input stage is operable to generate respective first components of the first and second drive signals having respective first and second temperature coefficients; and the bias stage is operable to cause the input stage to generate second components of the first and second drive signals having respective third and fourth temperature coefficients, the first and third temperature coefficients being of opposite polarity, the second and fourth temperature coefficients being of opposite polarity, such that the first and second drive signals having substantially zero temperature coefficients.

33. An integrated circuit, comprising:

a reference generator, comprising an output stage operable to provide a reference signal having a substantially constant value over a temperature range, a differential amplifier having first and second input nodes and having an output node coupled to the output stage, an input stage coupled to the amplifier and operable to drive the first and second input nodes with respective first and second drive signals, and a bias stage coupled to the input stage and operable to maintain the first and drive signals within a signal range over the temperature range, the bias stage being responsive to a current value based on the band gap voltage that is mirrored through a reference voltage.

34. A system, comprising:

a first integrated circuit, comprising a reference generator, comprising an output stage operable to provide a reference signal having a substantially constant value over a temperature range, a differential amplifier having first and second input nodes and having an output node coupled to the output stage, an input stage coupled to the amplifier and operable to drive the first and second input nodes with respective first and second drive signals, and a bias stage coupled to the input stage and operable to maintain the first and drive signals within a signal range over the temperature range, the bias stage being responsive to a current value based on the band gap voltage that is mirrored through a reference voltage; and a second integrated circuit coupled to the first integrated circuit.

35. The system of claim 34 wherein the first or second integrated circuit comprises a controller.

36. The system of claim 34 wherein the first and second integrated circuits are disposed on a same die.

37. The system of claim 34 wherein the first and second integrated circuits are respectively disposed on first and second dies.

* * * * *